US007073326B2

(12) United States Patent
Cheong

(10) Patent No.: US 7,073,326 B2
(45) Date of Patent: Jul. 11, 2006

(54) DIESEL PARTICULATE MATTER REDUCTION SYSTEM AND A METHOD THEREOF

(75) Inventor: Jae Hoon Cheong, Gwangmyeong (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/747,906

(22) Filed: Dec. 29, 2003

(65) Prior Publication Data

US 2005/0086932 A1 Apr. 28, 2005

(30) Foreign Application Priority Data

Oct. 24, 2003 (KR) ..... 10-2003-0074755

(51) Int. Cl.
*F01N 3/00* (2006.01)

(52) U.S. Cl. ..... 60/295; 60/274; 60/289; 60/297; 60/300

(58) Field of Classification Search ..... 60/274, 60/289, 297, 286, 300, 311, 295; 141/98, 141/392

See application file for complete search history.

(56) References Cited

U.S. PATENT DOCUMENTS 4,562,695 A * 1/1986 Rao et al. ..... 60/286
4,899,540 A * 2/1990 Wagner et al. ..... 60/274
5,090,200 A * 2/1992 Arai ..... 60/286
5,388,400 A * 2/1995 Hoppenstedt et al. ..... 60/274
5,458,673 A * 10/1995 Kojima et al. ..... 95/11
5,489,319 A * 2/1996 Tokuda et al. ..... 96/400
6,471,918 B1 * 10/2002 Sherwood ..... 422/171
2003/0010399 A1 * 1/2003 Friebe et al. ..... 141/98

FOREIGN PATENT DOCUMENTS

| | | |
|---|---|---|
| JP | 07-026942 | 1/1995 |
| JP | 07-150930 | 6/1995 |
| JP | 2000-170520 | 6/2000 |
| JP | 2001-073721 | 6/2000 |

* cited by examiner

*Primary Examiner*—Tu M. Nguyen
(74) *Attorney, Agent, or Firm*—Morgan Lewis & Bockius LLP

(57) ABSTRACT

A diesel particulate matter reduction system includes a diesel particulate filter (DPF), an electric power supply device, a heater, an air blower, and a control unit. The DPF is configured to capture particulate matter of exhaust gas. The heater is configured to be operated by electric power supplied by the electric power supply device to heat the DPF. The air blower is configured to be operated by electric power supplied by the electric power supply device and provides air to the DPF. The control unit controls operations of the heater and the air blower.

10 Claims, 2 Drawing Sheets

DIESEL PARTICULATE MATTER REDUCTION SYSTEM AND A METHOD THEREOF

CROSS-REFERENCE TO RELATED APPLICATIONS

This application claims priority of Korean Application No. 10-2003-0074755, filed on Oct. 24, 2003, the disclosure of which is incorporated fully herein by reference.

FIELD OF THE INVENTION

The present invention relates to a method for reducing particulate matter of diesel engines, and more particularly, to a method for reducing particulate matter of diesel engines using a diesel particulate filter, and a system thereof.

BACKGROUND OF THE INVENTION

Technology for reducing exhaust emissions has become an important issue because various regulations for noxious exhaust emissions of a vehicle have been prepared.

In a diesel engine, a reduction of exhaust emissions is especially important. In particular, particulate matter that is mainly generated by incomplete burning of fuel must be decreased. Various technologies for reducing such particulate matter of a diesel engine have been introduced.

DPF (Diesel Particulate Filter) technology is one of such technologies. In DPF technology, particulate matter is collected by a filter and the collected particulate matter is burned by a burner or a heater.

In DPF technology, a regeneration process for oxidizing the collected matter (e.g., soot) collected by the filter is used. There are various regeneration methods. As an example, there is passive DPF method using an additive, a passive CRT (Continuously Regeneration Trap) method, an active CPF (Catalyzed Particulate Filter) method, and an active DPNR (Diesel Particulate NOx Reduction) method.

The passive method, in which the filter is continuously regenerated when predetermined conditions are satisfied, is not suitable for city driving. Therefore, the active type method, in which exhaust gas is heated during regeneration of the filter by a heater or through fuel injection control, is more relevant for normal vehicles. That is, the CPF method or the DPNR method is more suitable for a vehicle driven primarily in the city.

In the CPF or DPNR methods, regeneration of the DPF is performed while the vehicle is running. The regeneration of the filter is easily performed using exhaust gas when the vehicle is running at a high speed or under a high load. However, when the load is small, the exhaust gas temperature must be increased for the regeneration. In order to increase the temperature of the exhaust gas, the temperature of exhaust gas in a diesel oxidation catalyst (DOC) must be increased through post-injection.

Fuel is consumed for the regeneration of the DPF through the post-injection, so fuel mileage deteriorates. Furthermore, because of late fuel injection timing, fuel is directly injected on a lubricant oil layer on an inner wall of a cylinder, so the oil may be diluted. In addition, because exhaust gas recirculation is not performed during the regeneration process, noxious emissions such as NOx are increased. It is also difficult to determine timing of the generation.

The information disclosed in this Background of the Invention section is only for enhancement of understanding of the background of the invention and should not be taken as an acknowledgement or any form of suggestion that this information forms the prior art that is already known to a person skilled in the art.

SUMMARY OF THE INVENTION

Embodiments of the present invention provide a diesel particulate matter reduction system and method in which regeneration of a diesel particulate filter can be easily performed using electric power of a fuel supply nozzle.

In a preferred embodiment of the present invention, the diesel particulate matter reduction system comprises a diesel particulate filter (DPF), an electric power supply device, a heater, an air blower, and a control unit. The DPF is configured to capture particulate matter of exhaust gas. The heater is configured to be operated by electric power supplied by the electric power supply device to heat the DPF. The air blower is configured to be operated by electric power supplied by the electric power supply device and provides air to the DPF. The control unit controls operations of the heater and the air blower.

It is preferable that the electric power supply device includes a fuel supply nozzle having an electric power source, wherein the control unit is electrically connected to the electric power source of the fuel supply nozzle when the fuel supply nozzle is inserted into a fuel supply hole of a vehicle.

It is further preferable that the control unit includes an electric power supply plug that is disposed near the fuel supply hole, and wherein the fuel supply nozzle is provided with an electric power supply socket into which the electric power supply plug can be inserted.

It is still further preferable that the electric power supply plug and the electric power supply socket are respectively disposed such that the electric power supply plug can be inserted into the electric power supply socket when the fuel supply nozzle is inserted into the fuel supply hole.

It is preferable that the heater is disposed upstream of the DPF.

Preferably, the diesel particulate matter reduction system further comprises a temperature sensor detecting a temperature of the heater and generating a corresponding signal, wherein the control unit controls the electric power to be supplied to the heater until the temperature of the heater reaches a predetermined temperature based on the signal of the temperature sensor.

In a preferred embodiment of the present invention, the diesel particulate matter reduction method comprises: capturing diesel particulate matter of exhaust gas using the DPF; and regenerating the DPF by removing the captured particulate matter. The regenerating of the DPF comprises: heating the DPF using electric power that is supplied from an external electric power supply device such that the captured particulate matter can be burned; and sending air to the DPF.

It is preferable that the external electric power supply device is a fuel supply nozzle that is provided with an electric power source.

It is further preferable that the heating of the DPF is performed by operating a heater using the electric power of the fuel supply nozzle, the heater being disposed near the DPF.

It is still further preferable that the heater is disposed upstream of the DPF.

Preferably, in the heating of the DPF, the heater is controlled to operate until a temperature thereof reaches a predetermined temperature.

Further preferably, in the heating of the DPF, the heater is controlled to not operate after the temperature thereof reaches the predetermined temperature.

It is preferable that the sending is performed by operating an air blower using the electric power of the fuel supply nozzle.

BRIEF DESCRIPTION OF THE DRAWINGS

The accompanying drawings, which are incorporated in and constitute a part of the specification, illustrate an embodiment of the invention, and, together with the description, serve to explain the principles of the invention, wherein.

DETAILED DESCRIPTION OF THE PREFERRED EMBODIMENTS

Hereinafter, a preferred embodiment of the present invention will be described in detail with reference to the accompanying drawings.

Figure 1:
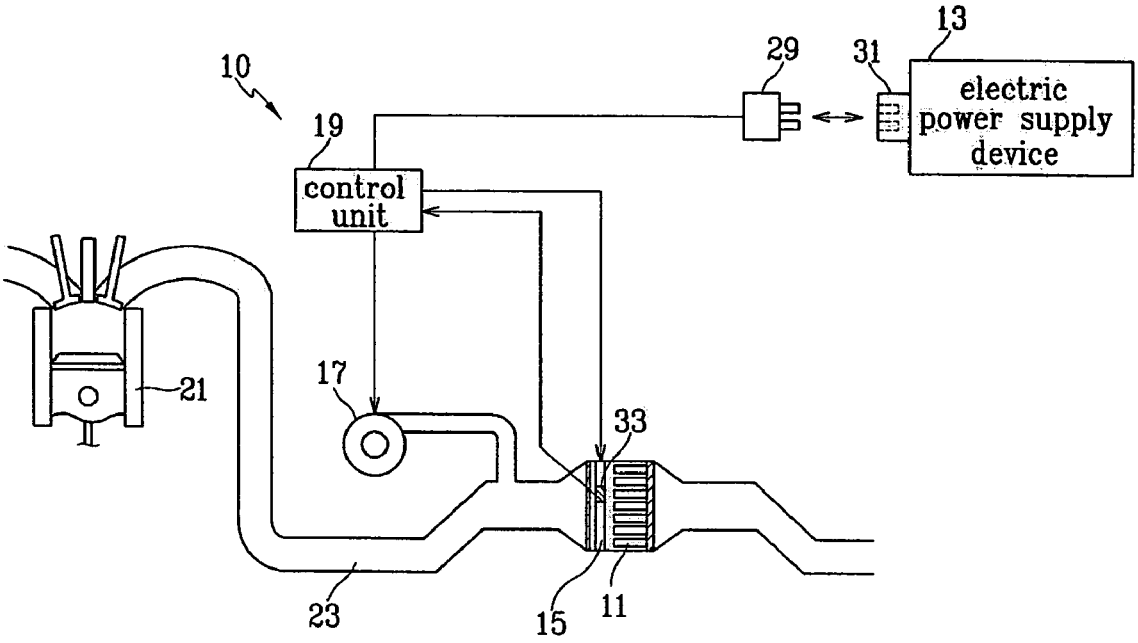
FIG. 1 is a schematic diagram of a system for reducing particulate matter for a diesel engine according to an embodiment of the present invention.

As shown in FIG. 1, a diesel particulate matter reduction system 10 according to an embodiment of the present invention comprises a diesel particulate filter (DPF) 11, an electric power supply device 13, a heater 15, an air blower 17, and a control unit 19. The DPF 11 is disposed in an exhaust gas passageway 23 of a diesel engine 21 to capture particulate matter in exhaust gas. The heater 15 is operated by electric power that is supplied by the electric power supply device 13. If the electric power is supplied to the heater 15, the heater 15 emits heat. As an example, the heater 15 can be a coil.

The heater is preferably disposed near the DPF 11 such that the DPF 11 can be heated by the heater 15. As shown in FIG. 1, the heater 15 is disposed in the exhaust gas passageway 23 upstream of the DPF 11.

The air blower 17 is operated by electric power that is supplied by the electric power supply device 13. If the electric power is supplied to the air blower 17, the air blower 17 provides air to the DPF 11.

In a preferred embodiment, the electric power supply device 13 is a fuel supply nozzle 13 including an electric power source. The fuel supply nozzle 13 can includes a normal fuel supply nozzle that is used for supplying fuel to a vehicle. The fuel supply nozzle generally includes an electric power source that is needed for its operation. So, in an embodiment of the present invention, the electric power of the fuel supply nozzle is used to operate the heater 15 and the air blower 17. The control unit 19 controls the electric power supply from the fuel supply nozzle 13 to the heater 15 and the air blower 17. That is, the control unit 19 controls the operations of the heater 15 and the air blower 17.

The control unit 19 may comprise a processor and associated hardware as may be selected and programmed by a person of ordinary skill in the art, based on the teachings of the present invention.

Figure 2:
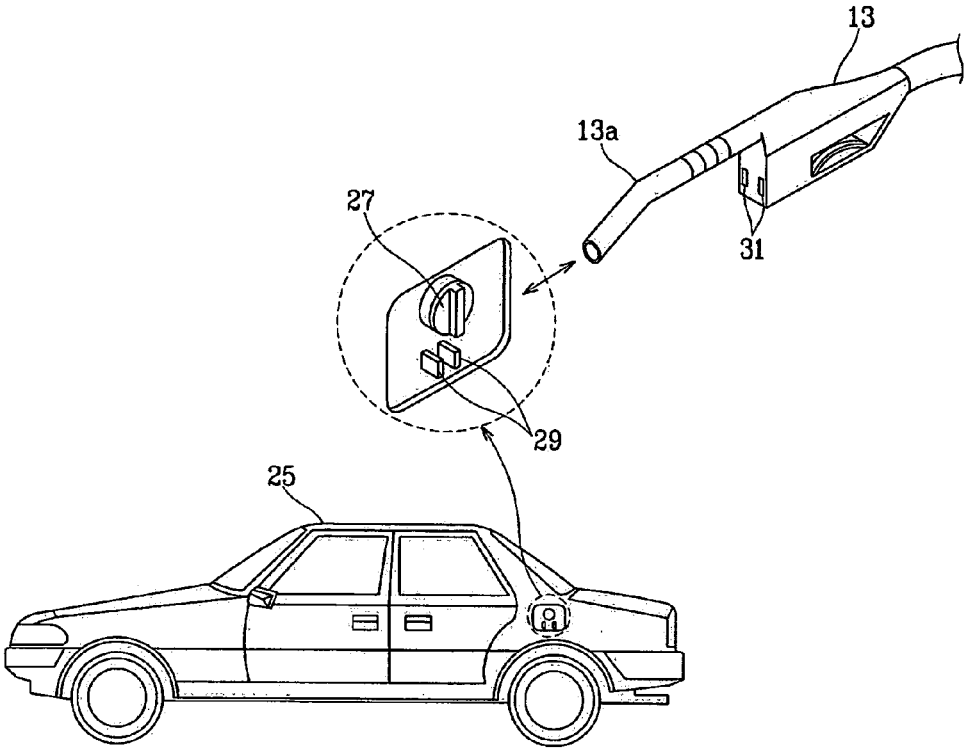
FIG. 2 shows an electric power supply device of FIG. 1.

As shown in FIGS. 1 and 2, the control unit 19 includes an electric power supply plug 29 that is disposed near a fuel supply hole 27 of a vehicle 25. The fuel supply nozzle 13 is provided with an electric power supply socket 31 into which the electric power supply plug 29 can be inserted. When a front end 13*a* of the fuel supply nozzle 13 is inserted into the fuel supply hole 27, the electric power supply plug 29 is inserted into the electric power supply socket 31.

If the electric power supply plug 29 is inserted into the electric power supply socket 31, that is, if the electric power supply plug 29 is electrically connected to the electric power supply socket 31, the electric power of the fuel supply nozzle 13 is supplied to the control unit 19. That is, if the fuel supply nozzle 13 is inserted into the fuel supply hole 27, the control unit 19 is provided with the electric power. Using the electric power, the control unit 19 controls the heater 15 and the air blower 17 to operate.

If the electric current is supplied to the heater 15, the heater 15 emits heat, and the DPF 11 is heated by the heat of the heater 15. Consequently, the particulate matter captured by the DPF 11 is burned. If the electric current is supplied to the air blower 17, the air blower 17 sends air to the DPF 11, so that the burned matter is blown away from the DPF 11.

A particulate matter reduction system 10 according to the embodiment of the present invention further includes a temperature sensor 33 that detects a temperature of the heater 15 and generates a corresponding signal.

The control unit 19 receives the signal indicative of the temperature of the heater 15 from the temperature sensor 33, and controls the operation of the heater 15 based on the temperature of the heater 15. The control unit 19 controls the heater 15 to be supplied with the electric current until the temperature of the heater 15 reaches a predetermined temperature. The predetermined temperature can be determined as a temperature at which the captured particulate matter can be burned. As an example, the predetermined temperature can be 600 degrees Celsius.

Figure 3:
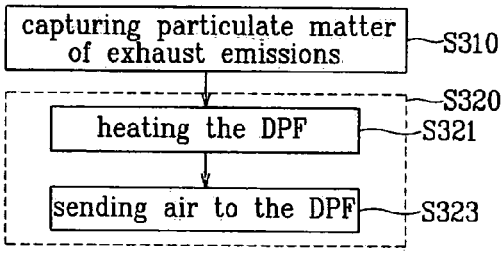
FIG. 3 is a flowchart of a method for reducing particulate matter according to an embodiment of the present invention.

Referring to FIG. 3, the diesel particulate matter reduction method according to the embodiment of the present invention will be explained.

The diesel particulate matter reduction method according to an embodiment of the present invention may uses the above-stated diesel particulate matter reduction system 10.

A diesel particulate matter reduction method comprises capturing particulate matter of exhaust emissions (S310) and regenerating the DPF 11 by removing the captured particulate matter (S320).

Step S320 includes heating the DPF 11 using the electric power supplied by the fuel supply nozzle 13 to burn the captured particulate matter (S321) and sending air to the DPF 111 (S323).

Step S321 can be performed by operating the heater 15 that is disposed near the DPF 11 using the electric power supplied from the fuel supply nozzle 13.

In step S321, it is preferable that the heater 15 is controlled to operate until its temperature reaches the predetermined temperature (e.g., 600 degrees Celsius), and the heater 15 is controlled to not operate after its temperature reaches the predetermined temperature.

Step S323 can be performed by operating the air blower 17 using the electric power supplied from the fuel supply nozzle 13.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

According to the embodiments of the present invention, the DPF can be regenerated using the external electric power source, so that the DPF can be regenerated while the vehicle is not running.

In particular, because the DPF is regenerated using the electric power of the fuel supply nozzle while fuel is supplied to a vehicle, it is possible to prevent the exhaust emission characteristics from being deteriorated.

Furthermore, the electric power is supplied using the electric power supply plug that is disposed near the fuel supply hole and the electric power supply socket that is provided in the fuel supply nozzle, so that the DPF can be easily regenerated while fuel is supplied to the vehicle.

What is claimed is:

1. A diesel particulate matter reduction method using a diesel particulate filter (DPF), comprising:

capturing diesel particulate matter of exhaust gas using the DPF; and regenerating the DPF by removing the captured particulate matter, wherein the regenerating of the DPF comprises:

heating the DPF using electric power that is supplied from an external electric power supply device such that the captured particulate matter can be burned wherein the electric power supply device includes a fuel supply nozzle having an electric power source; and sending air to the DPF, wherein said heating and sending are initiated by a control unit, and wherein said control unit is electrically connected to the electric power source of the fuel supply nozzle when the fuel supply nozzle is inserted into a fuel supply hole of a vehicle.

2. The diesel particulate matter reduction method of claim 1, wherein the heater is disposed upstream of the DPF.

3. The diesel particulate matter reduction method of claim 1, wherein the sending is performed by operating an air blower using the electric power of the fuel supply nozzle.

4. The diesel particulate matter reduction method of claim 1, wherein in the heating of the DPF, the heater is controlled to operate until a temperature thereof reaches a predetermined temperature.

5. The diesel particulate matter reduction method of claim 4, wherein in the heating of the DPF, the heater is controlled to not operate after the temperature thereof reaches the predetermined temperature.

6. A diesel particulate matter reduction system comprising:

a diesel particulate filter (DPF) configured to capture particulate matter of exhaust gas;

an electric power supply device;

a heater configured to be operated by electric power supplied by the electric power supply device to heat the DPF;

an air blower configured to be operated by electric power supplied by the electric power supply device and providing air to the DPF; and a control unit controlling operations of the heater and the air blower;

wherein the electric power supply device includes a fuel supply nozzle having an electric power source; and wherein the control unit is electrically connected to the electric power source of the fuel supply nozzle and initiates operation of the heater and air blower using electric power supplied from the fuel supply nozzle when the fuel supply nozzle is inserted into a fuel supply hole of a vehicle.

7. The diesel particulate matter reduction system of claim 6, wherein the heater is disposed upstream of the DPF.

8. The diesel particulate matter reduction system of claim 6, further comprising a temperature sensor detecting a temperature of the heater and generating a corresponding signal, wherein the control unit controls the electric power to be supplied to the heater until the temperature of the heater reaches a predetermined temperature based on the signal of the temperature sensor.

9. The diesel particulate matter reduction system of claim 6, wherein the control unit includes an electric power supply plug that is disposed near the fuel supply hole, and wherein the fuel supply nozzle is provided with an electric power supply socket into which the electric power supply plug can be inserted.

10. The diesel particulate matter reduction system of claim 9, wherein the electric power supply plug and the electric power supply socket are respectively disposed such that the electric power supply plug can be inserted into the electric power supply socket when the fuel supply nozzle is inserted into the fuel supply hole.

* * * * *